US006665998B1

(12) United States Patent
Boegli

(10) Patent No.: US 6,665,998 B1
(45) Date of Patent: Dec. 23, 2003

(54) EMBOSSING DEVICE FOR PLANAR MATERIALS

(75) Inventor: Charles Boegli, Marin (CH)

(73) Assignee: Boegli-Gravures SA, Marin (CH)

( * ) Notice: Subject to any disclaimer, the term of this patent is extended or adjusted under 35 U.S.C. 154(b) by 0 days.

(21) Appl. No.: 09/572,437

(22) Filed: May 17, 2000

(51) Int. Cl.[7] ..... B65B 61/26

(52) U.S. Cl. ..... 53/131.4; 101/5; 101/3.1; 101/22; 101/23; 493/241; 493/364

(58) Field of Search ..... 53/131.4; 101/4–6, 101/3.1, 14, 22–24, 26; 493/241, 351, 364

(56) References Cited

U.S. PATENT DOCUMENTS

| | | | | | |
|---|---|---|---|---|---|
| 1,111,334 | A | * | 9/1914 | Wait | 101/23 |
| 2,601,793 | A | | 7/1952 | Wood | 80/55 |
| 2,681,611 | A | * | 6/1954 | Jacobs | 101/23 |
| 3,173,361 | A | * | 3/1965 | Verlik | 101/216 |
| 3,500,744 | A | * | 3/1970 | Lewis | 101/23 |
| 4,280,978 | A | | 7/1981 | Dannheim et al. | 264/156 |
| 4,732,082 | A | * | 3/1988 | Ireton | 101/23 |
| 5,590,557 | A | * | 1/1997 | Keller et al. | 72/238 |
| 5,598,774 | A | | 2/1997 | Boegli | 100/170 |
| 5,715,749 | A | * | 2/1998 | Miller | 101/216 |
| 5,816,144 | A | | 10/1998 | Schandl et al. | 100/47 |
| 5,960,714 | A | | 10/1999 | Göttling et al. | 101/216 |
| 6,178,718 | B1 | * | 1/2001 | Focke et al. | 53/131.4 |

FOREIGN PATENT DOCUMENTS

| | | |
|---|---|---|
| DE | 43 42 737 | 6/1995 |
| DE | 197 40 129 | 3/1999 |
| EP | 0 244 492 | 11/1987 |
| EP | 0 925 911 | 6/1999 |
| FR | 1 575 080 | 7/1969 |
| GB | 1 075 701 | 7/1967 |
| GB | 1 260 118 | 1/1972 |
| JP | 55-024706 | 2/1980 |

OTHER PUBLICATIONS

Patent Abstracts of Japan, vol. 004, No. 161 (M–040), Nov. 11, 1980.

Patent Abstracts of Japan, vol. 012, No. 137 (M–690), Apr. 26, 1988.

* cited by examiner

*Primary Examiner*—Stephen F. Gerrity
*Assistant Examiner*—Thanh Truong
(74) *Attorney, Agent, or Firm*—Foley & Lardner

(57) ABSTRACT

The embossing rolls of embossing devices serving for the treatment of two-dimensionally extending materials, preferably in the packaging industry, may be made exchangeable if they are disposed in suitable interchangeable units. An interchangeable unit may e.g. take the form of a sleeve having its ends provided with fitting surfaces. The mount of an embossing device comprises corresponding seats which are very precisely adapted to the actual interchangeable unit. In the inserted condition, i.e. when the fitting surfaces of the retaining elements are inserted in the associated seats, the embossing roll contained in an exchangeable unit is thus placed in its operational position without requiring any further adjusting operations. Particularly the driven embossing roll of such an embossing device is thus substantially less complicated to exchange, thereby allowing quick maintenance and production changeovers.

30 Claims, 9 Drawing Sheets

EMBOSSING DEVICE FOR PLANAR MATERIALS

FIELD OF THE INVENTION

The present invention refers to an embossing device for planar materials, more particularly in the form of strips or bands, including at least two embossing rolls, i.e. a first, driven roll and a mating roll, which are arranged in parallel to each other in a mount and capable of being aligned in a position of defined mutual contact, and which is preferably used for the packaging of tobacco products.

BACKGROUND OF THE INVENTION

Embossing devices of this kind are e.g. used in the packaging industry for the purpose of embossing packing materials while seals, devices, etc. are preferably stamped at the same time. In this context, the term embossing means providing the surface with a fine pattern in the millimeter and the submillimeter range. Sheet packing materials of this kind are e.g. used for the packaging of tobacco products (cigarettes), foods, chocolates, chewing gums, etc. An embossing device for this purpose is described in U.S. Pat. No. 5,598,774 of the same applicant.

The requirements with respect to such embossing devices, such as high operating speeds (e.g. 1.8 m/s), a fine, absolutely regular pattern, as well as an otherwise faultless embossing over prolonged, continuous periods of operation require a high precision in the construction and the installation of such embossing machines. Therefore, in the embodiments of the prior art, the entire so-called embossing head, i.e. a mount in which the embossing rolls are supported and which includes an adjusting device, inter alia, is attached to the embossing machine as an external component. These embossing heads may weigh more than 50 kg in some cases.

However, since the rolls are exposed to a calculable wear, regular servicing of the embossing heads is necessary. In particular, the rolls have to be exchanged from time to time. But the conversion e.g. to a different surface structure, a different seal or a different format also requires an exchange of the rolls. With the embossing heads of the prior art, this implies removing the entire embossing head, bringing it to a workshop where the necessary work is done, remounting the embossing head, and possibly effecting an additional, time-consuming readjustment on account of the inevitable loss of the adjustment involved in the process. Such an operation may take several hours, and due to the heavy weight, at least two people or additional lifting equipment are required in order to remove the embossing head and to remount it to the packaging machine.

For a quicker changeover, it is convenient to have a second embossing head ready. However, on one hand, this solution is very expensive financially, and on the other hand, it does not eliminate the need of precisely adjusting the newly mounted embossing head to the material feed in the packaging machine.

U.S. Pat. No. 5,590,557 discloses a roll stand for a pair of rolls which is arranged in a cassette, thus allowing an easy exchange of the rolls. The cassette comprises spindles in order to allow a precise mutual adjustment of the rolls, which is a problem in installations of that kind, but of no importance in the present device.

SUMMARY OF THE INVENTION

On the background of this prior art, it is the object of the present invention to provide an embossing device of the mentioned kind which allows an easier exchange of embossing rolls without requiring a pre-adjustment.

This object is attained by an embossing device wherein at least one of said embossing rolls is contained in an interchangeable unit, wherein the interchangeable unit comprises retaining means, and wherein said mount comprises seats whose shape is essentially complementary to the retaining means, so that the interchangeable unit is insertable in a predetermined position in said mount by inserting the retaining means in the associated seats. The further claims indicate preferred embodiments.

The invention is based upon the discovery that it is not absolutely necessary to support the embossing rolls directly in the mount of the embossing device. The driven embossing roll is coupled to the driving unit of the packaging machine, and it must be precisely adjusted to the feeding direction of the embossed material.

BRIEF DESCRIPTION OF THE DRAWINGS

The invention shall be explained in more detail hereinafter with reference to drawings of exemplary embodiments.

Corresponding parts in the different figures are designated by the same reference numerals.

DETAILED DESCRIPTION OF THE INVENTION

Figure 1:
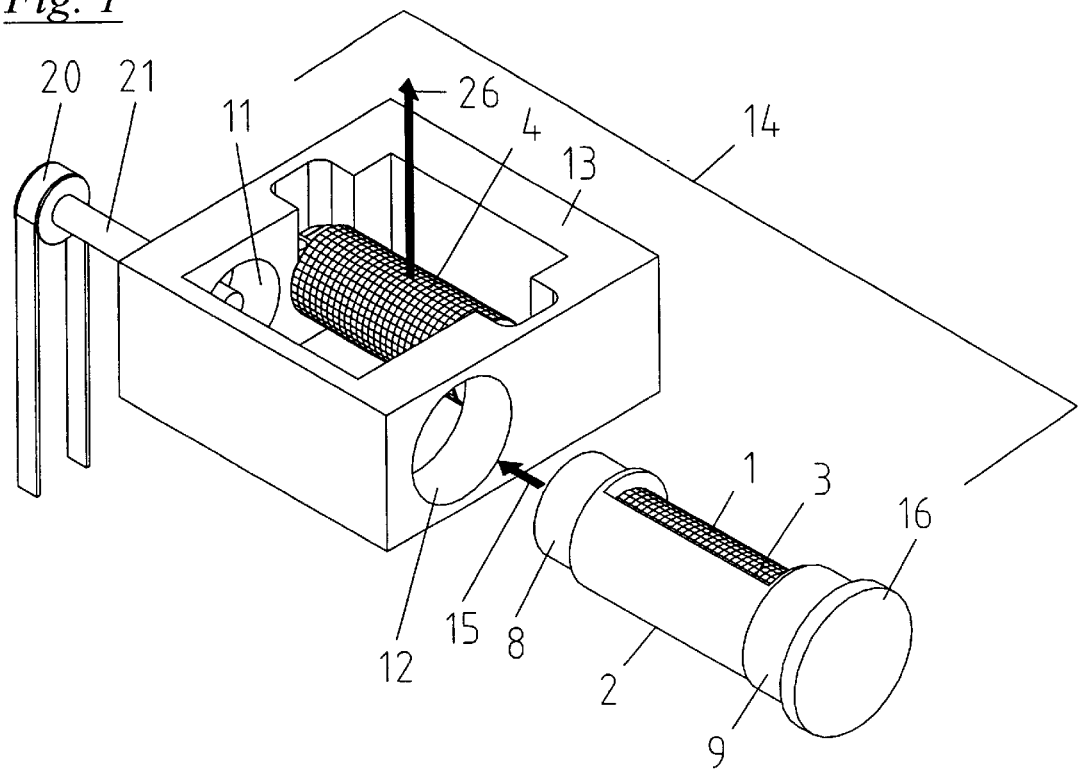
FIG. 1 shows a spatial view of a first embodiment.
Figure 2:
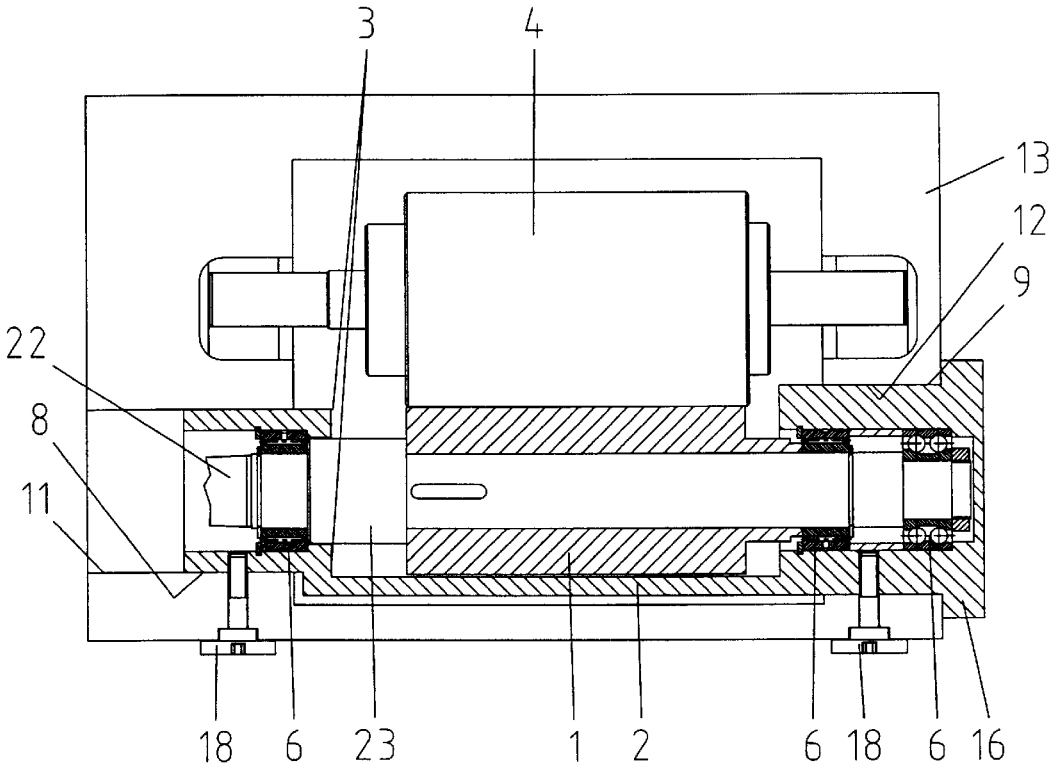
FIG. 2 shows a top view of the first embodiment with a partial section of a removable embossing roll.

FIGS. 1 and 2 show a first embodiment of the invention where driven embossing roll 1 is rotatably supported in a generally cylindrical sleeve 2. Sleeve 2 comprises a cutout 3 across the working length of embossing roll 1, thus allowing to apply mating roll 4 to embossing roll 1 (see FIG. 2).

The driven, first embossing roll 1 is rotatably supported in sleeve 2 with precision by means of rolling bearings 6. Both ends of the sleeve are provided with respective fitting surfaces 8 and 9 which are precisely adapted to openings 11 and 12 of mount 13 of embossing device 14. Sleeve 2 can thus be introduced into mount 13 in the direction of arrow 15 until end plate 16 touches mount 13, simultaneously providing a precise radial positioning of driven embossing roll 1 in mount 13 by means of drive 20. By inserting locking screws 18 into sleeve 2, the latter is fixed in a predetermined, optimal rotational position and also kept from being shaken out, for example. A shaft 21 of external drive unit 20 illustrated in FIG. 1 engages in opening 11. As sleeve 2 is inserted, drive end 22 is coupled to drive end 23 of embossing roll 1. The coupling may be obtained in different ways which are known in the art and depend on the local situation, e.g. by drivers or toothings. The coupling operation may require rotating embossing roll 1 to a determined position, which may be effected either by acting upon embossing roll 1 through cutout 3 or else by rotating second shaft end 24 of driven embossing roll 1, which in this case would be designed such as to be accessible through end plate 16, for example.

As schematically indicated in FIG. 1, mating roll 4 is upwardly removable (arrow 26) after releasing its attachment to a conventional retaining device, which preferably also allows to move the embossing rolls away from each other, e.g. according to the cited U.S. Patent of the applicant. The construction of the retaining device of mating roll 4 is therefore not further illustrated in the figures and need not be explained in more detail.

In contrast to the schematic representation of FIG. 1, FIG. 2 clearly shows that fitting surface 8 has a smaller diameter than embossing roll 1, so that it is sufficient to lift off mating roll 4 from embossing roll 1 by releasing the tensioning device in order to be able to pull the latter out of mount 13. As this embodiment shows, it is thereby possible to exchange only the embossing rolls without the need of removing the mount along with all the additional apparatus such as driving devices as well. Also, the mount can be realized as a fixed component of a packaging machine. The easy interchangeability of the parts which are mainly exposed to wear (embossing rolls, bearings) also allows a more ecological maintenance since less parts are required.

Due to the simplicity of the changeover, it is also possible with corresponding adaptations, e.g. the replacement of the locking screws with pins or the like, to perform the exchange of the embossing rollers semi- or entirely automatically. Also, in this context, means might be provided in order to monitor the wear of the embossing rolls by corresponding sensors, either on the product or directly on the embossing rolls. The sensors or any other measuring devices might also be able to read a code provided on the embossing rolls, thus allowing an automatic recognition of the inserted embossing rolls. One possibility of an automatic wear control consists in providing a polished, smooth zone which surrounds one end of the roll. The relative position of the surface of this measuring zone with respect to the mount can be detected highly precisely e.g. by means of an optical sensor. The necessary sensor arrays for this purpose are known per se. The wear of the surfaces of the embossing rolls provided with the embossing pattern, which is e.g. formed of pyramids in the micrometer range up to a few millimeters, results in a movement of the embossing rolls with respect to the mount, thus generating a corresponding signal of the sensors. In usual embossing rolls, the travel of a roll amounts to e.g. 150 $\mu$m when the surface is totally worn. If the signal exceeds a certain threshold, i.e. when the wear has reached a certain limit, an exchange of the embossing rolls may be requested, either through a corresponding signal for the operators or through activation of a semi- or fully automatic exchanging system.

According to the U.S. Patent mentioned in the introduction or according to European Patent No. 925 911 of the same applicant, the mating roll is free-wheeling and, as disclosed in the cited references, self-synchronizing if the axle is correspondingly journalled.

Figure 12:
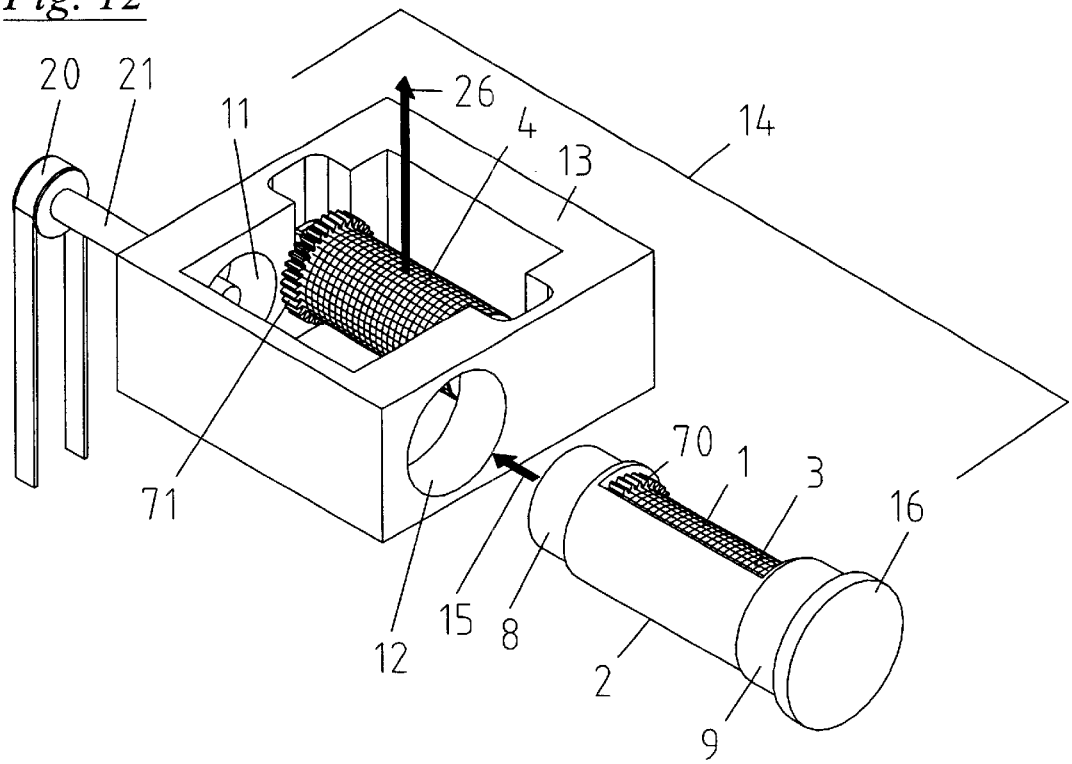
FIG. 12 shows a spatial view of a ninth embodiment where the embossing rolls are synchronized within the interchangeable unit.
Figure 13:
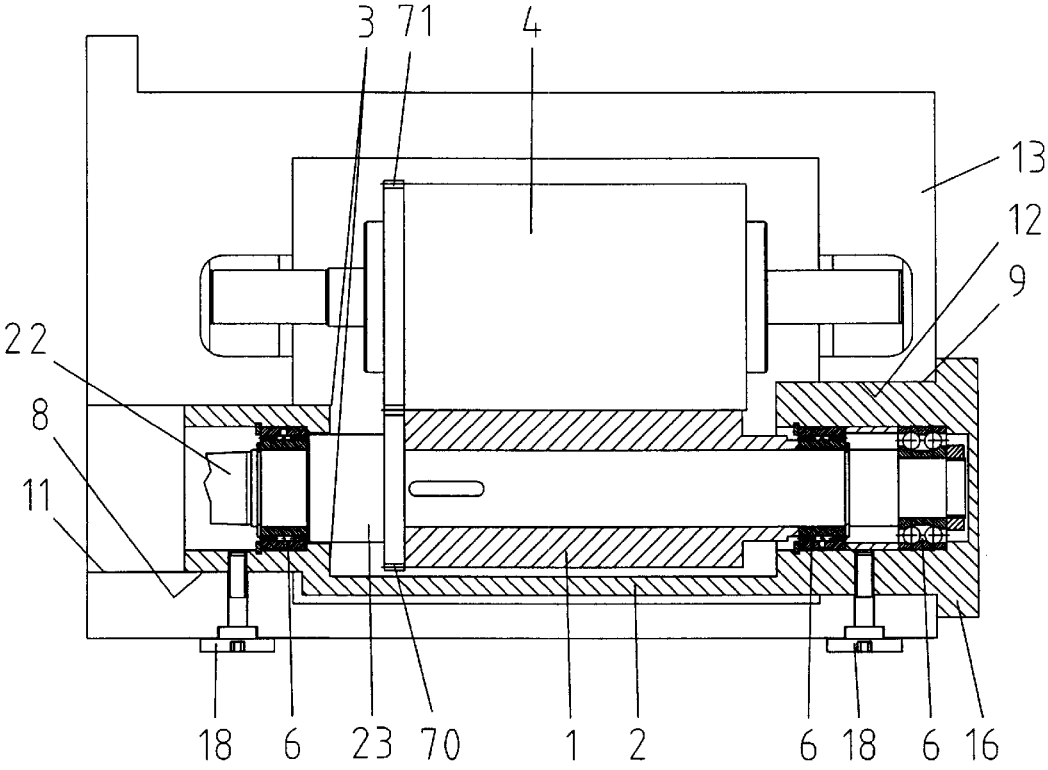
FIG. 13 shows a top view in analogy to FIG. 2 of the ninth embodiment.

By a modification of sleeve 2 in such a manner that-in addition to the driven roll, it also accommodates the mating roll, it is possible to precisely synchronize the two embossing rolls in their relative rotational position as well. In this case, the frame does not necessarily have to be undivided, but it may also comprise a plurality of independent portions, one of which contains the driven roll in the manner of the sleeve while a second one receives the mating roll. Preferably, the frame is assembled and its components are mutually fixed only when they are inserted in the corresponding seats of mount 13. An example thereof is mentioned hereinafter in the ninth embodiment (FIGS. 12, 13).

Figure 16:
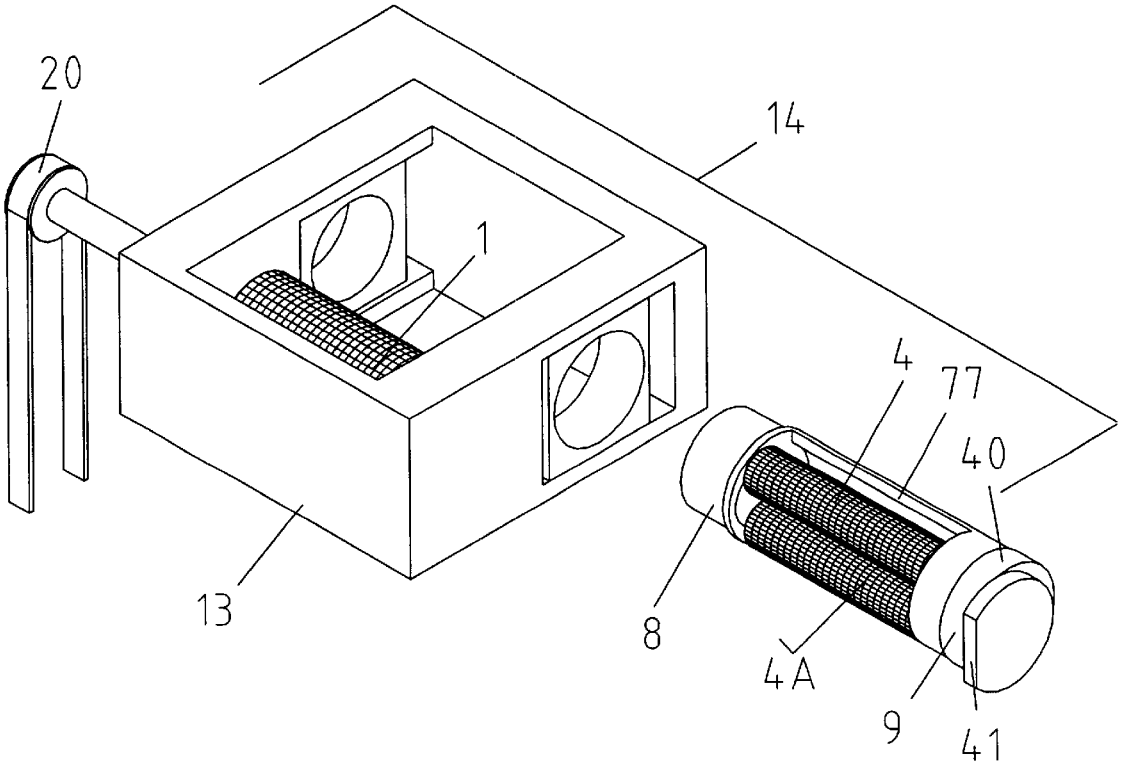
FIG. 16 shows a spatial view of another embodiment having a sleeve comprising two mating rolls.

It is also conceivable to use the construction of the invention for multiple roll systems, e.g. as described in previously unpublished Swiss Patent Application No. 1999 09929/99, see FIG. 16. Multiple roll systems are devices where a plurality, particularly more than two rolls are involved in the embossing and/or transport process.

Figure 3:
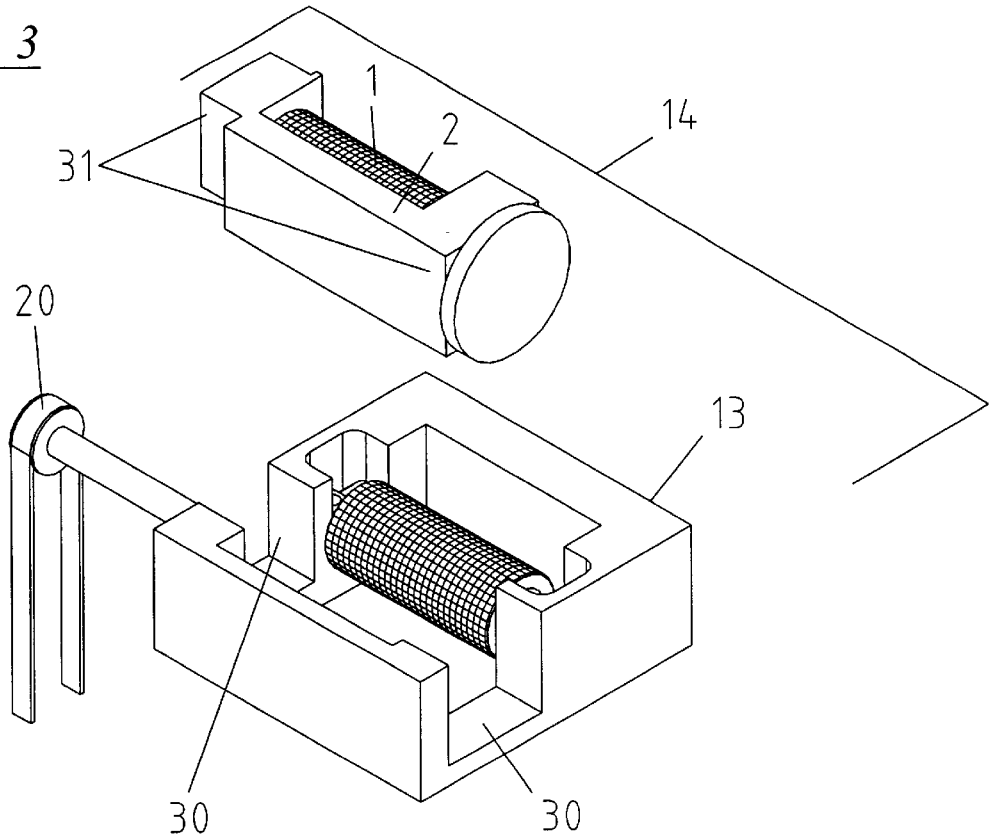
FIGS. 3 to 7 show spatial views of embodiments two to six.

The exemplary embodiments described hereinafter illustrate a number of alternatives:

In FIG. 3, mount 13 comprises essentially rectangular seats 30 in which the corresponding sleeve, now provided with rectangular fitting surfaces 31, is inserted resp. removed from above.

Figure 4:
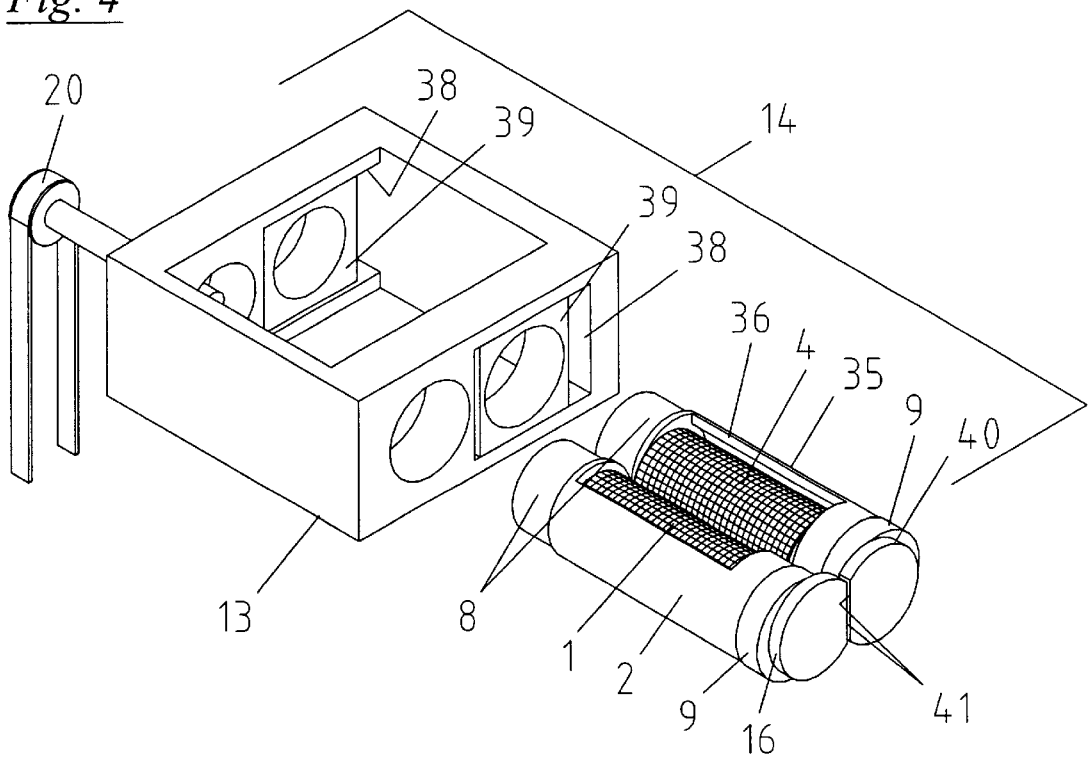

FIG. 4 shows an alternative embodiment where both the driven embossing roll 1 and mating roll 4 are contained in sleeves 2 resp. 35. In this case, mating roll 4 is disposed eccentrically in sleeve 35 in such a manner that it projects sufficiently from the front side of cutout 36 to be able-to be pressed against the surface of driven embossing roll 1. This movement towards the driven embossing roll 1 is ensured by retainers 39 which are displaceable in slots 38. Retainers 39 are connected to a non-represented adjusting and contact pressure device according to the prior art.

The necessary alignment with respect to the rotational position of sleeves 2 and 35 is ensured by end plates 16 and 40, respectively, which only allow embossing rolls 1 and 4 to be sufficiently approached for operation in the allowable position. In the example, this is obtained by the fact that they comprise a straight section 41 each.

Figure 5:
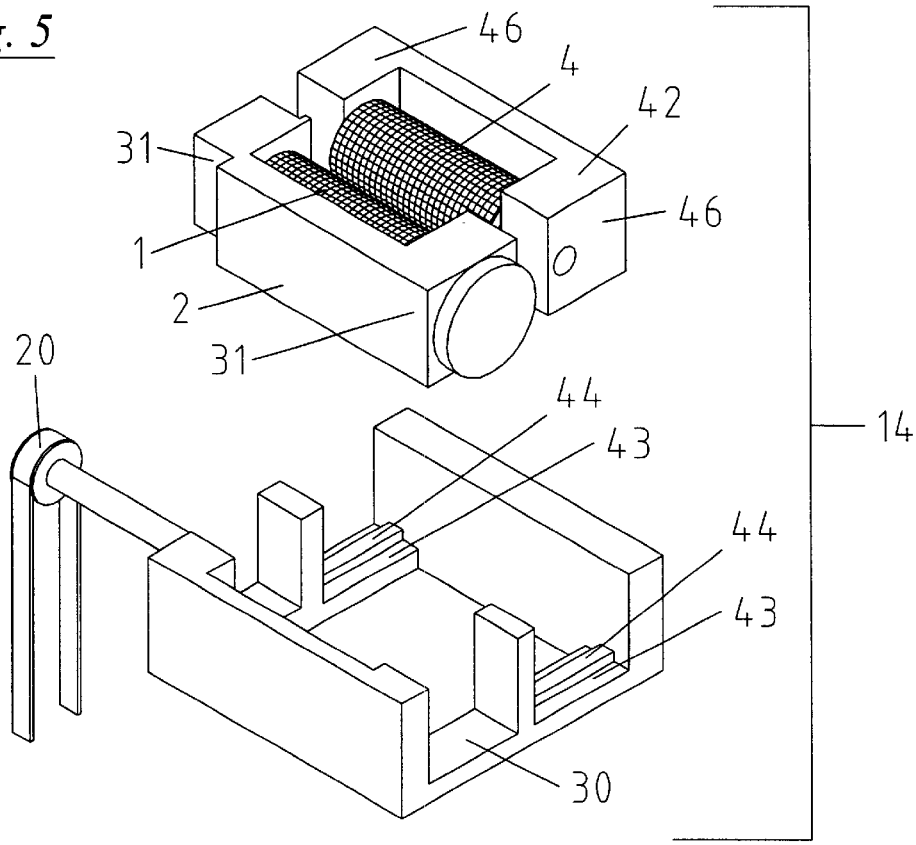

FIG. 5 shows an embodiment which essentially corresponds to that of FIG. 3 as far as driven embossing roll 1 is concerned. In this case, however, mating roll 4 is also supported in a U-shaped holder 42. Holder 42 is inserted in recesses 43 comprising respective guide rails 44 at the bottom, the guide rails being received, when the holder is inserted, by grooves (not shown) which are provided at the bottom of end pieces 46. The grooves are precisely adjusted to rails 44, whereby a precise axial positioning of the mating roll is obtained. Holder 42 with mating roll 4 is displaceable towards driven embossing roll 1 along rails 44. This movement, as well as the defined contact pressure on first embossing roll 1, may again be provided by an adjusting and contact pressure device according to the prior art. An illustration is therefore omitted.

Figure 6:
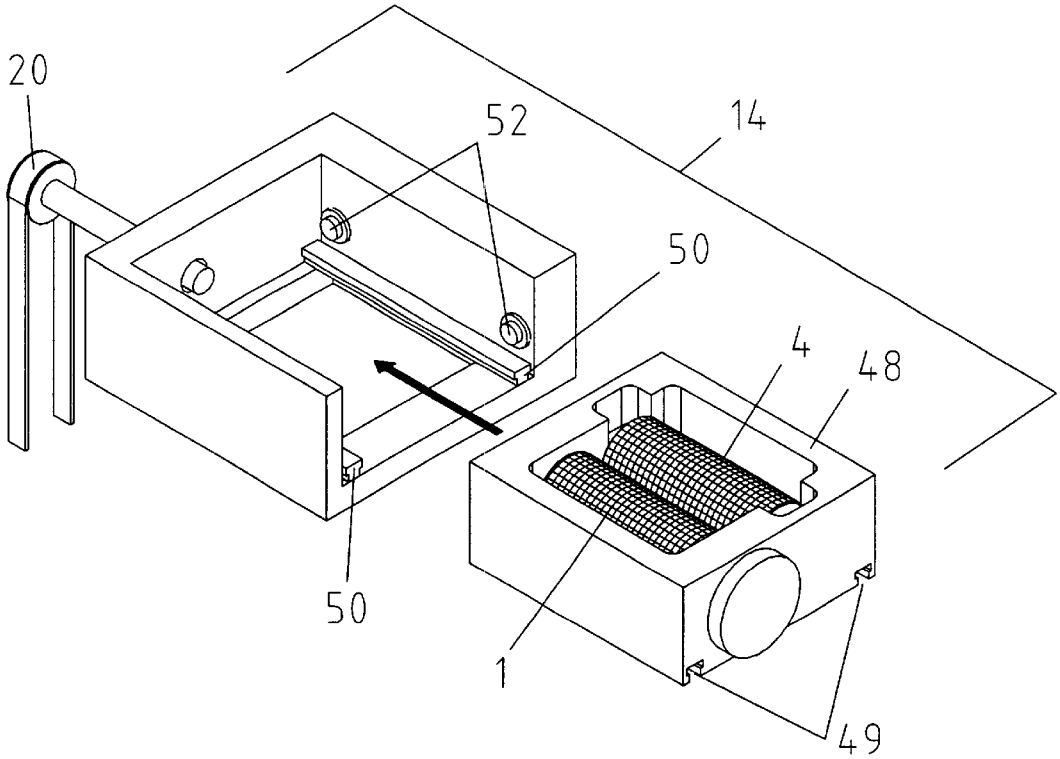

FIG. 6 shows an embodiment where driven roll 1 and mating roll 4 are contained in an interchangeable frame 48. The bottom of interchangeable frame 48 comprises T-shaped grooves 49 which allow its fitting, lateral insertion into mount 13 on rails 50 in the direction of arrow 51. During the inserting procedure, the exemplary push pieces 52 of the adjusting and contact pressure device for mating roll 4 are retracted, and as soon as interchangeable frame 48 is inserted, they are advanced to their working position in order to supply a defined contact pressure of second embossing roll 4 on first embossing roll 1. Since the active position of push pieces 52 is defined, no new adjustment is required for this purpose either, but it is sufficient to bring the adjusting device from the rest position, which allows the insertion, to the predefined working position.

Figure 7:
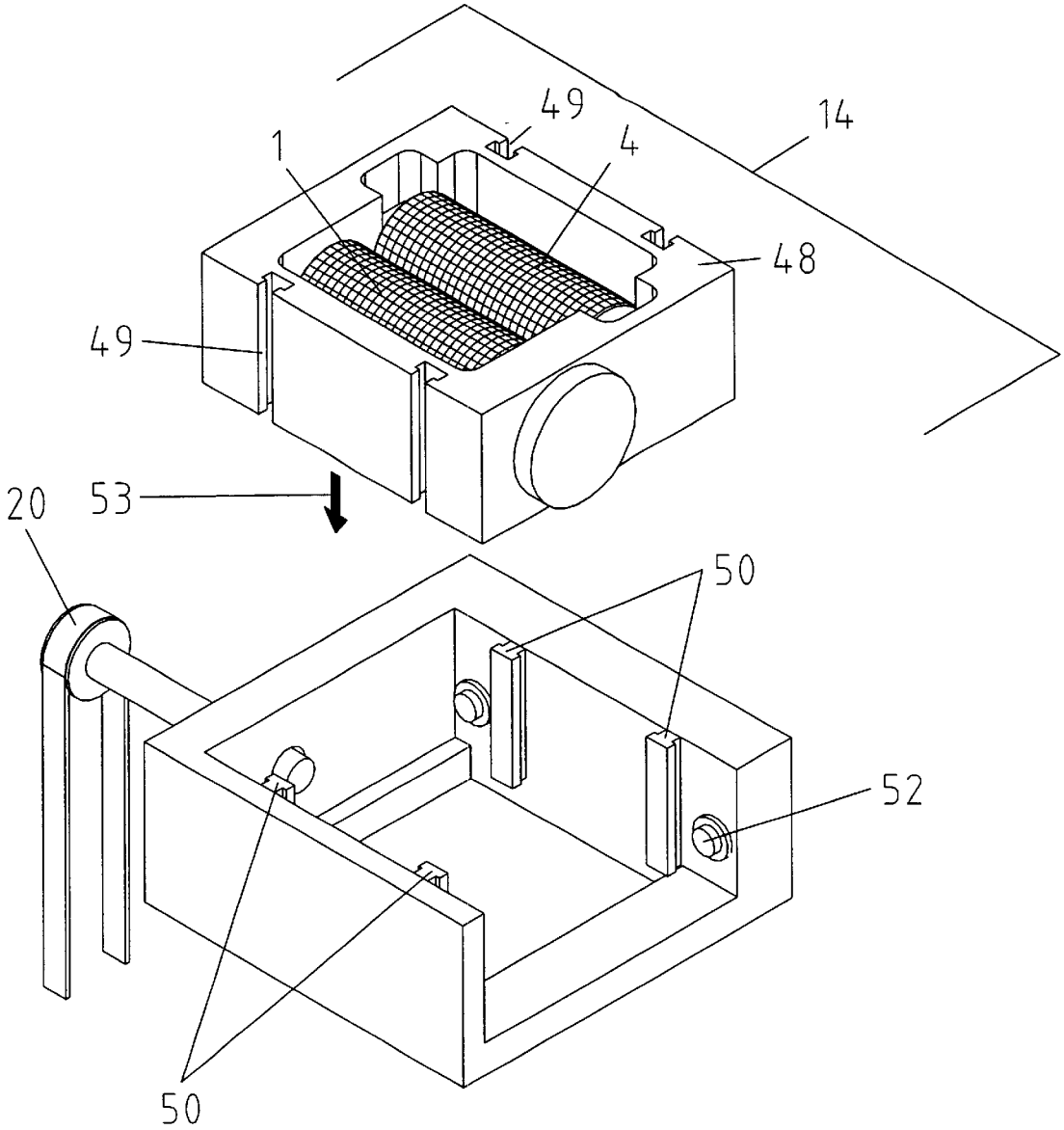

FIG. 7 shows an embodiment which is similar to that of FIG. 6 but where interchangeable frame 48 and rails 50 are designed in such a manner that interchangeable frame 48 with embossing rolls 1, 4 can be inserted into mount 13 from above according to arrow 53.

Figure 8:
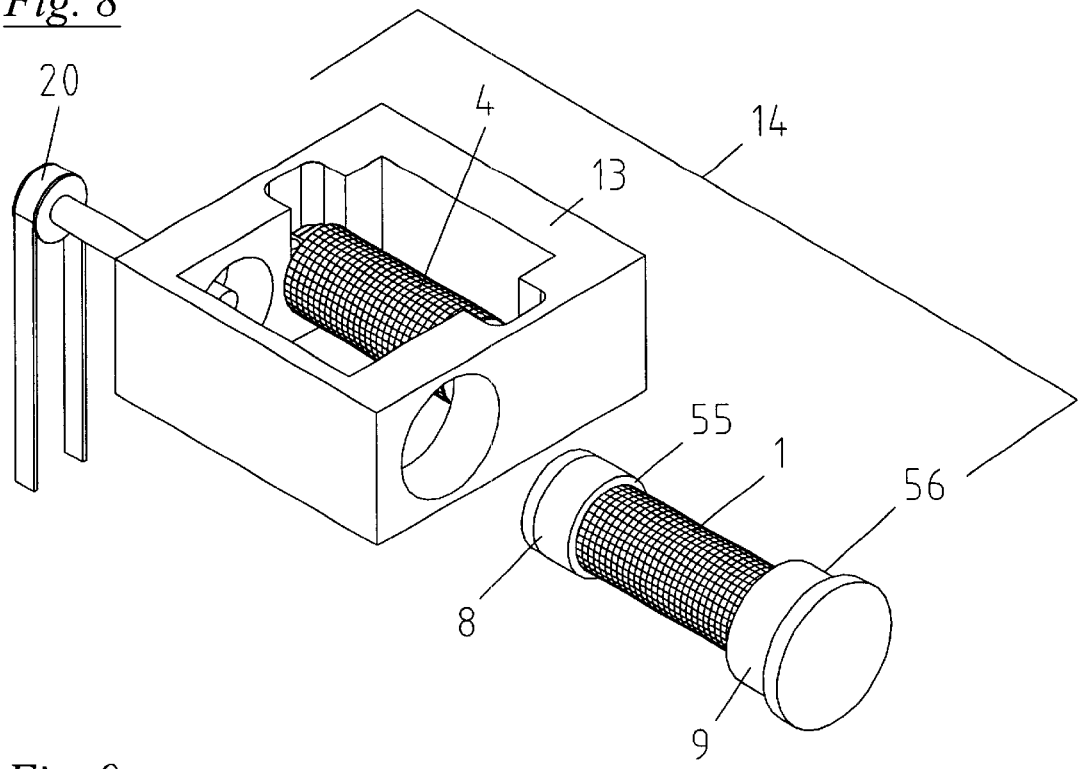
FIG. 8 shows a spatial view of a seventh embodiment having non-connected retaining means for the embossing roll.
Figure 9:
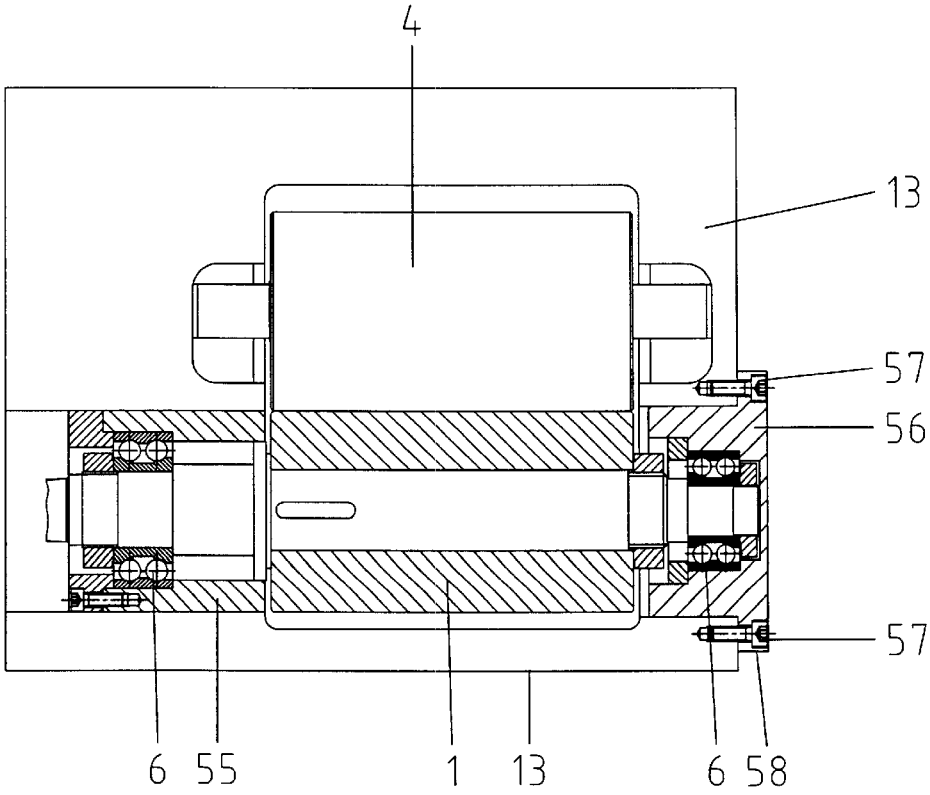
FIG. 9 shows a representation in analogy to FIG. 2 of the seventh embodiment.

FIGS. 8 and 9 show an alternative embodiment where the center portion of sleeve 2 is omitted, i.e. embossing roll 1 is accessible on its entire circumference. Both sides of embossing roll 1 are provided with fitting portions 55 (drive side) and 56, respectively, which contain the bearings 6 of embossing roll 1 and comprise peripheral fitting surfaces 8 and 9, respectively. In its application, the embodiment is similar to that of FIGS. 1 and 2, particularly with respect to the inserting procedure. In this case, however, it is preferably fastened by screws 57 which are inserted in mount 13 in the axial direction of embossing roll 1 through the rim 58 of end plate 16.

Figure 10:
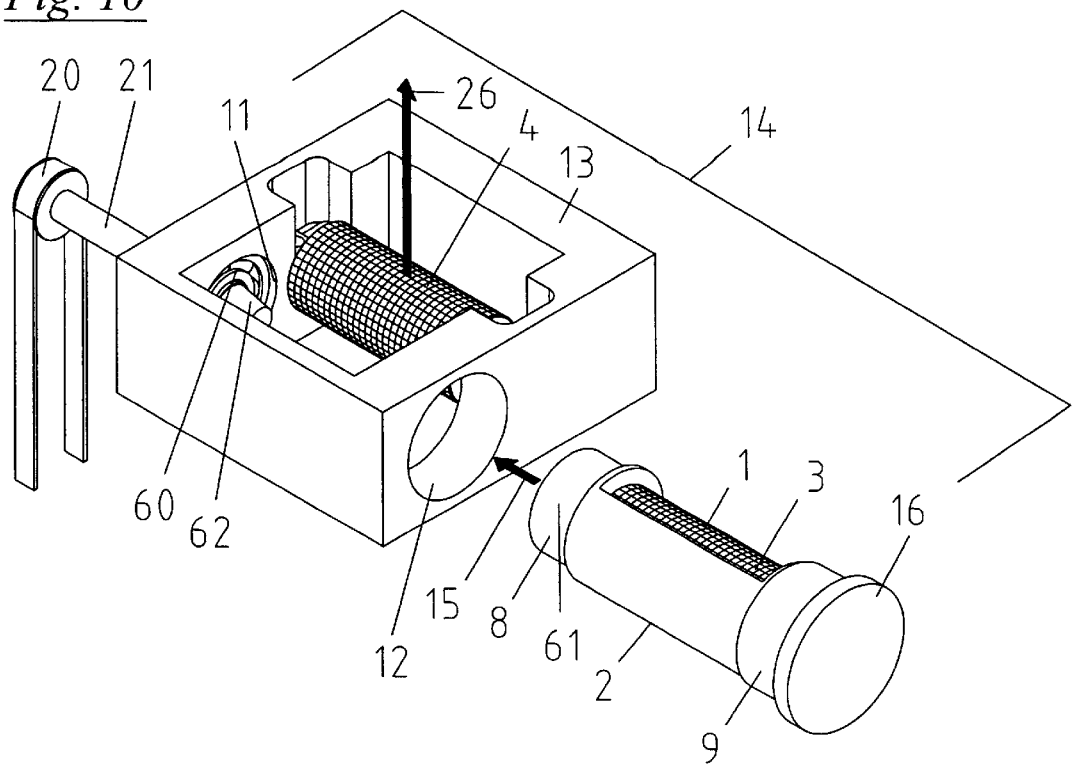
FIG. 10 shows a spatial view of an eighth embodiment where a bearing for the embossing roll is provided in the mount.
Figure 11:
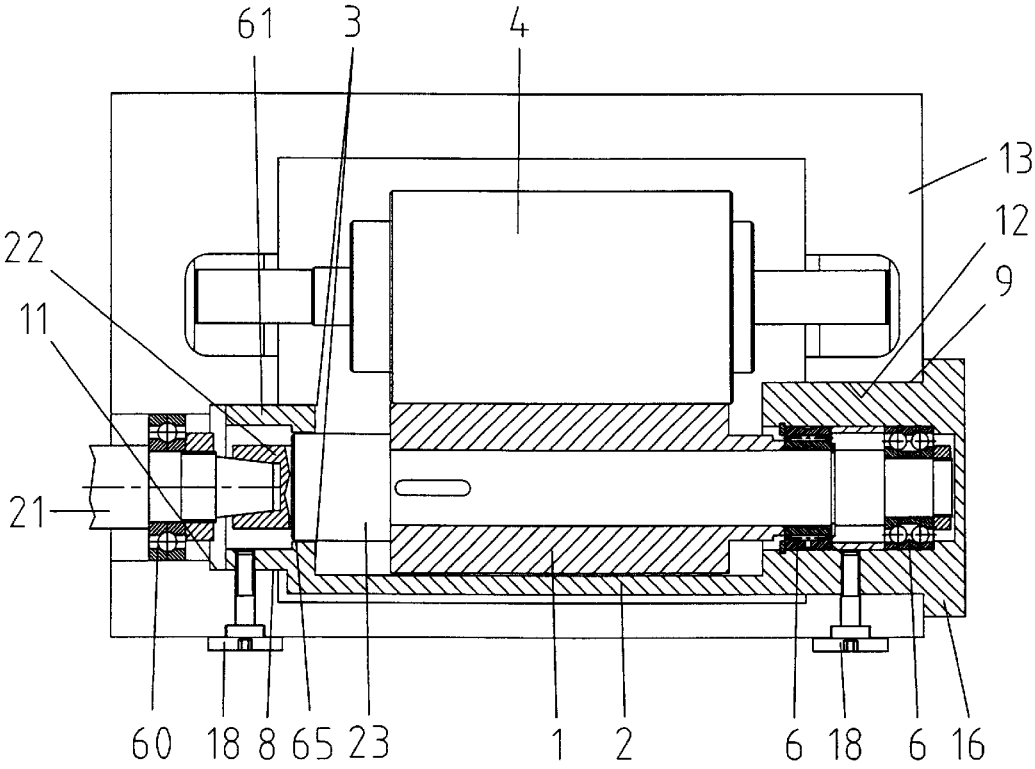
FIG. 11 shows a top view in analogy to FIG. 2 of the eighth embodiment.

FIGS. 10 and 11 show an embodiment where bearing 60 on the drive side is arranged in mount 13 and receives journal 62. End portion 61 now only comprises an annular support 65 for embossing roll 1 in order to hold the latter in a certain position (preferably approximately centrally) for changeover and storage such that end portion 22 of embossing roll 1, which comprises an inner cone, can be slipped on and coupled to complementary, conically shaped journal 62. End portion 22 of the embossing roll may be in the form of an axle, as illustrated, or integrated in the roll body.

FIGS. 12 and 13 show an embodiment similar to that of FIGS. 1 and 2 but where the two embossing rolls 1 and 4 comprise respective gear rims 70, 71. In the operative condition (FIG. 13), the gear rims are in engagement with each other and embossing rolls 1, 4 are positively synchronized.

Figure 14:
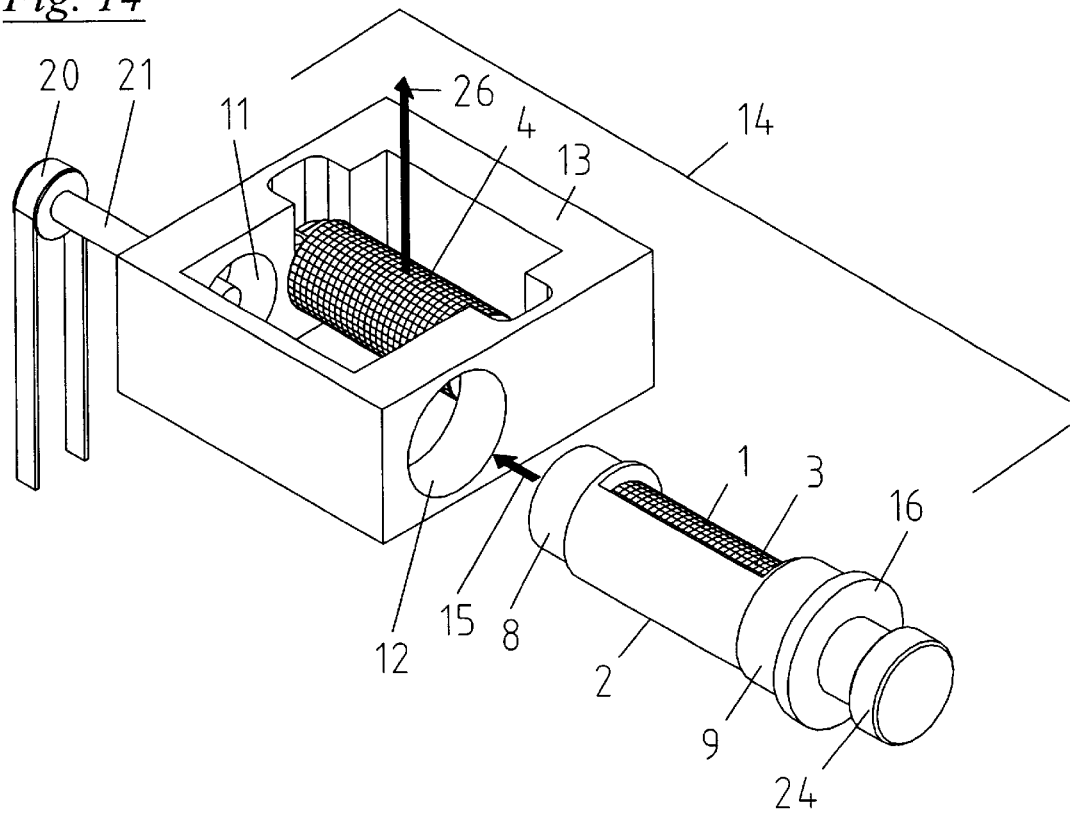
FIG. 14 shows a spatial view of a tenth embodiment-having a turning knob allowing to turn an embossing roll.
Figure 15:
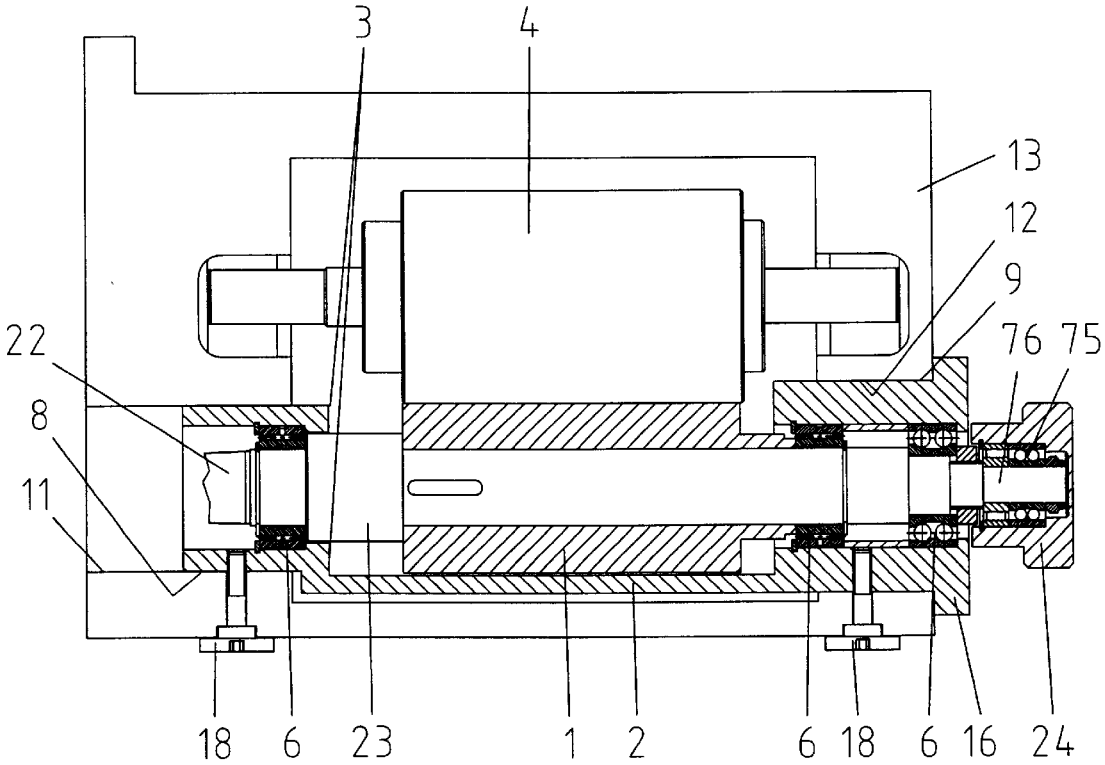
FIG. 15 shows a top view in analogy to FIG. 2 of the tenth embodiment.

FIGS. 14 and 15 show an embodiment similar to that of FIGS. 1 and 2 comprising a turning knob 24 allowing to rotate embossing roll 1 to a suitable position e.g. for coupling it to shaft end 22 by a coarse toothing. The turning knob is connected to shaft end 76 of embossing roll 1 by means of a free-wheel or a drag clutch 75 so that knob 24 is not compulsorily rotated in operation.

FIG. 16 shows an alternative embodiment where driven embossing roll 1 is arranged in mount 13 individually and two mating rolls 4 and 4A are arranged in sleeve 77, the latter comprising the previously described fitting surface 8 and end plate 40. Such an arrangement of more than one mating roll may e.g. be used for so-called shadow or double embossing techniques where the two mating rolls are arranged according to a determined mutual alignment.

From the preceding description, modifications of the represented embodiments are accessible to those skilled in the art without leaving the scope of the invention. More particularly, the embossing device may be arranged in any spatial orientation. Also, the indicated alternatives, more particularly with respect to the coupling of the embossing rolls and the manual rotation by means of the turning knob, can be combined with each other.

The sides resp. the end plates of the cassette portions, of mount 13, or of fitting portions 55, 56 may e.g. comprise synchronizing means such as toothed gears or belt drives in order to synchronize the rotation of the embossing rolls. Consequently, a synchronization of some or of all embossing rolls 1, 4 by corresponding gears is possible, the coupling of the gear elements possibly being effected only in the course of the insertion of rolls 1, 4 in mount 13.

Also, one or several ones of the following modifications are possible:

- The rotation symmetrical interchangeable units, i.e. sleeve 2 or fitting portions 55, 56 as well as the corresponding seats in the mount (13), are provided with rotational locking elements such as pairs of tongues and grooves, in order to allow an insertion in a determined rotational position only, or with shapes which are different from the radial symmetrical one, e.g. elliptical shapes.
- Retaining means are provided which engage an end of the embossing rolls directly, so that the ends of the embossing rolls serve as axles and distinct axles can be omitted.
- The embossing rolls are generally driven, preferably by a motor or another drive. Instead of being coupled to the drive of the packaging machine, they may e.g. be driven by a dedicated motor, which is preferably synchronized with that of the connected machine, particularly of the packaging machine, however.
- Magnetic locking means for the interchangeable unit.
- Insertion of the interchangeable unit by a combination of radial and axial movements of the interchangeable unit, e.g. insertion from the top until the embossing roll is aligned with a driving journal, and subsequent axial movement to slip it onto the journal.
- Use of one or several interchangeable units for mating rolls (4) exclusively.

Numerous further advantages follow from the preceding description. According to the prior art, the mating roll was connected to the corresponding adjusting and/or contact pressure device by relatively easily accessible screws and was therefore less complicated to exchange by itself in the embossing heads of the prior art already. However, the resulting benefit was limited since in order to change an embossed emblem, both rolls have to be exchanged as the embossing rolls adapt to each other in operation and disturbances and increased wear may result if only one of the two rolls is exchanged. Also, it is possible to keep respective pairs of embossing rolls for different embossing tasks without requiring intolerable investments.

Even if only the mating rolls are provided with retaining means while the driven embossing rolls are held in the mount conventionally, there is still an improvement in service friendliness since the exchange of a conventionally supported mating roll is indeed simpler than that of a driven embossing roll, but nevertheless a time-consuming operation which is substantially simplified with the present invention. In this context, the invention gains additional significance due to a recent trend to use several mating rolls, which might make it possible to restrict the wear, particularly of the surface provided with the embossing pattern, to the mating roll(s) essentially.

It further follows from the description that the embossing device of the invention is suitable both for idle embossing rolls where each tooth of one roll engages between four adjacent teeth of the mating roll, according to European Patent No. 925 911 of the same applicant, and for positively synchronized rolls where each tooth of one roll engages in a corresponding recess of the mating roll, as well as for mixed systems if more than two rolls are present.

All in all, the described embodiments of the invention further offer one or several ones of the following advantages:

1) An embossing head equipped with the quick change system of the invention may be fixedly mounted to a packaging machine, i.e. form a fixed component thereof.
2) An operation by a single person is possible since the invention results in a substantial weight reduction of the component parts which have to be handled in the case of a conversion or maintenance, i.e., in particular, essentially only the embossing rolls themselves. Consequently, lower manufacturing costs are another result.
3) The costs of acquisition are lower since in the case of new embossing requirements for an existing embossing head, only the corresponding embossing rolls of the quick change system have to be acquired.
4) Maintenance and assembly/disassembly of the embossing rolls are substantially simplified.
5) The manufacturing technique is more ecological since less mechanical parts are required.

What is claimed is:

1. An embossing device for planar materials in the form of strips or bands comprising:

a mount;

at least two embossing rolls including a first driven roll and a second mating roll configured to be alignable in said mount in parallel to each other in relative positions of defined mutual contact; and an interchangeable unit configured to retain at least one of said at least two embossing rolls;

wherein said mount includes seats to receive said interchangeable unit in a predetermined position; and wherein said first roll and said second roll are removable independent of each other.

2. The device of claim 1, wherein at least said first driven roll is disposed in said interchangeable unit.

3. The device of claim 2, further comprising a second interchangeable unit that is insertable in a predetermined position in said mount, wherein said second mating roll is disposed in said second interchangeable unit.

4. The device of claim 2, wherein one or more mating rolls are disposed in said interchangeable unit with said first driven roll.

5. The device of claim 1, wherein at least said second mating roll is disposed in said interchangeable unit.

6. The device of claim 1, wherein at least one of said at least two rolls disposed in said interchangeable unit includes a manually operated positioning element which allows the roll to be rotated to a certain rotational position to couple said roll disposed in said interchangeable unit to a drive as said interchangeable unit is inserted in the mount.

7. The device of claim 1, further comprising a lock to lock said interchangeable unit in said mount in a predetermined position such that removal and reinsertion of said interchangeable unit can be effected without substantial loss of adjustment in operational condition.

8. The device of claim 7, wherein said lock comprises one or more of clamps, locking screws and a magnetic lock.

9. The device of claim 1, wherein said interchangeable unit includes components that are connected to each other to form a unitary structure which contains one or more of said rolls.

10. The device of claim 9, wherein said interchangeable unit comprises an interchangeable frame or a sleeve which contains one or more of said rolls.

11. The device of claim 1, wherein said first roll and said second roll are connected by synchronizing means that are disposed in said interchangeable unit, said synchronizing means defining a mutual rotational position of said first roll and second roll during operation of the device.

12. The device of claim 11, wherein said synchronizing means defines a mutual rotational position of said first roll and said second roll when said interchangeable unit is removed from said mount.

13. The device of claim 1, wherein said interchangeable unit includes first rotational locking means and said seats comprise second locking means that are complementary to said first locking means, so that said interchangeable unit is only insertable in said mount in a predetermined rotational position with respect to said mount.

14. The device of claim 1, wherein said interchangeable unit includes at least one bearing for the rotatable support of said embossing roll that is contained in said interchangeable unit.

15. The device of claim 1, wherein said interchangeable unit includes a rest for said first roll and a rotatable bearing for rotation of said first roll in said mount.

16. The device of claim 1, wherein said interchangeable unit contains at least two embossing rolls.

17. The device of claim 16, wherein said interchangeable unit contains said first driven roll and said second mating roll.

18. A packaging machine that includes the device of claim 1.

19. The packaging machine of claim 18, wherein said device is fixedly mounted to the packaging machine.

20. An embossing device for planar materials in the form of strips or bands comprising:

a mount;

at least two embossing rolls including a first driven roll and a second mating roll configured to be alignable in said mount in parallel to each other in relative positions of defined mutual contact, wherein rotational axes of said at least two embossing rolls define a common plane; and an interchangeable unit containing at least one of said at least two embossing rolls, said interchangeable unit including retaining means;

wherein said mount includes seats shaped essentially complementary to the retaining means, said interchangeable unit being insertable in a predetermined position in said mount in which said retaining means is disposed in said seats of said mount by inserting the interchangeable unit into the mount in either a direction substantially parallel to said rotational axes or a direction substantially perpendicular said common plane.

21. The device of claim 20, wherein said interchangeable unit is removable from and insertable in said mount in a direction parallel to the rotational axis of the at least one roll contained in said interchangeable unit.

22. The device of claim 21, wherein said seats comprise openings in said mount in which corresponding fitting surfaces of said interchangeable unit are adapted to fit.

23. The device of claim 20, wherein said interchangeable unit is removable from and insertable in said mount in a direction perpendicular to said common plane.

24. The device of claim 23, wherein said seats comprise rectangular shaped walls in which corresponding fitting surfaces of said interchangeable unit are adapted to fit.

25. The device of claim 20, wherein the first driven roll and the second mating roll can be removed from said mount independently of the other.

26. The device of claim 20, wherein one of said at least two rolls is removable from and insertable in said mount in a direction parallel to the rotational axes of the rolls and another of said at least two rolls is removable from and insertable in said mount in a direction perpendicular to said common plane.

27. A method for embossing superficial structures in planar materials, comprising:

providing an embossing device for planar materials that is comprised of:

a mount;

at least two embossing rolls including a first driven roll and a second mating roll configured to be alignable in said mount in parallel to each other in relative positions of defined mutual contact; and an interchangeable unit configured to retain at least one of said at least two embossing rolls;

wherein said mount includes seats to receive said interchangeable unit in a predetermined position; and wherein said first roll and said second roll are removable independent of each other; and passing said materials between said at least two rolls.

28. The method of claim 27, wherein the planar materials comprise a support of fibrous material with a metal coating on at least one side.

29. The method of claim 28, wherein the fibrous material is paper and the metal is aluminum.

30. The method of claim 27, wherein the planar materials comprise packages for tobacco or food products, wherein said passing produces shadow or double embossing on said packages in the millimeter or submillimeter range.

* * * * *